US011022411B2

(12) United States Patent
Chen

(10) Patent No.: US 11,022,411 B2
(45) Date of Patent: Jun. 1, 2021

(54) DART WITH TELESCOPIC TAIL WING

(71) Applicant: Dangcai Chen, Fujian (CN)

(72) Inventor: Dangcai Chen, Fujian (CN)

( * ) Notice: Subject to any disclaimer, the term of this patent is extended or adjusted under 35 U.S.C. 154(b) by 0 days.

(21) Appl. No.: 16/972,002

(22) PCT Filed: May 10, 2019

(86) PCT No.: PCT/CN2019/086315
§ 371 (c)(1),
(2) Date: Dec. 4, 2020

(87) PCT Pub. No.: WO2019/233243
PCT Pub. Date: Dec. 12, 2019

(65) Prior Publication Data

US 2021/0108900 A1 Apr. 15, 2021

(30) Foreign Application Priority Data

Jun. 5, 2018 (CN) ..... 201810582148.9

(51) Int. Cl.
*A63B 65/02* (2006.01)
*F42B 6/00* (2006.01)

(52) U.S. Cl.
CPC ..... *F42B 6/003* (2013.01)

(58) Field of Classification Search
CPC ..... F42B 6/003; F42B 6/06
See application file for complete search history.

(56) References Cited

U.S. PATENT DOCUMENTS 3,976,298 A * 8/1976 Hinchman, V ..... F42B 6/003 473/585
3,995,861 A * 12/1976 Clarke ..... F42B 6/003 473/586
4,842,285 A * 6/1989 Farler ..... F42B 6/003 473/585
5,573,251 A * 11/1996 Beard ..... F42B 6/003 29/517
5,642,887 A * 7/1997 Orav ..... F42B 6/003 473/586
5,899,824 A * 5/1999 Kurtz ..... F42B 6/003 473/578
9,435,620 B2 * 9/2016 Hamazaki ..... F42B 6/003
10,591,261 B1 * 3/2020 Gustafson ..... F42B 6/003

* cited by examiner

*Primary Examiner* — John A Ricci

(57) ABSTRACT

A dart with a telescopic tail wing composes a dart rod, a dart head disposed at a front end of the dart rod and a tail wing disposed at a rear end of the dart rod. A tail wing connecting part is disposed at the rear end of the dart rod. The tail wing comprises a sleeve and multiple wing blades disposed on the sleeve. A clamping part is disposed on the tail wing connecting part. A limiting part is disposed in the sleeve. The tail wing connecting part is inserted into the sleeve. The clamping part stretches from one side to the other side of the limiting part and is matched with the limiting part. An elastic piece is disposed around the tail wing connecting part. The tail wing can rotate on the tail connecting part and can telescopic. In case of a collision, the tail wing can rotate to reduce force, so that compared with the prior art, dart is simple in structure, easy to assemble and low in production cost.

6 Claims, 5 Drawing Sheets

DART WITH TELESCOPIC TAIL WING

BACKGROUND OF THE INVENTION

The invention relates to darts for dart sports, in particular, to a dart with a telescopic tail wing.

Dart sports is an interesting and competitive leisure sports event which is popular around the world and is easy to implement. In recent years, the professionalization of the dart sports brings about professional associations, professional matches and many professional athletes. With the generalization and professionalization of the dart sports, users put forward higher requirements for the quality and practicability of the darts.

Generally, in dart matches, if another dart is shot after one dart is previously shot into a target, this dart may exactly penetrate into the previous dart shot into the target. In this case, a large force will be generated on the two darts due to a collision, and if the collision happens repeatedly, the darts will be damaged due to fatigue failures.

BRIEF SUMMARY OF THE INVENTION

The technical issue to be settled by the invention is to overcome the defects of the prior art by providing a dart with a telescopic tail wing, which is simple in structure, easy to assemble and durable.

According to the main technical solution of a dart with a telescopic tail wing provided by the invention, the dart comprises a dart rod, a dart head disposed at a front end of the dart rod and a tail wing disposed at a rear end of the dart rod, wherein the tail wing is movably disposed on the dart rod, a tail wing connecting part is disposed at the rear end of the dart rod, the tail wing comprises a sleeve and multiple wing blades disposed on the sleeve, a clamping part is disposed on the tail wing connecting part, a limiting part is disposed in the sleeve, the tail wing connecting part is inserted into the sleeve, the clamping part stretches from one side to the other side of the limiting part and is matched with the limiting part, and an elastic piece is disposed around the tail wing connecting part and is located between the limiting part and the dart rod.

The dart with a telescopic tail wing provided by the invention further adopts the following auxiliary technical solution:

The elastic piece is located on one side of the limiting part and the clamping part is located on the other side of the limiting part.

A telescoping cavity is formed between the bottom of the sleeve and the limiting part, and the clamping part is located in the telescoping part.

The ratio of the depth of the telescoping cavity to the height of the clamping part is 10:1-2:1.

An air hole is formed in a side wall of the telescoping cavity.

A first gasket and a second gasket are also disposed around the tail wing connecting part and are located at two ends of the elastic piece, respectively.

The first gasket is located between the elastic piece and the dart rod, and the second gasket is located between the elastic piece and the limiting part.

The limiting part is an annular protrusion circumferentially disposed on an inner wall of the sleeve.

A front end of the tail wing connecting part is connected to the dart rod, and the clamping part is disposed at a rear end of the tail wing connecting part.

The clamping part comprises at least two elastic clamping blocks disposed at the rear end of the tail wing connecting part, and a gap is formed between every two adjacent elastic clamping blocks.

The dart rod comprises a first dart rod and a second dart rod which are detachably assembled together, wherein the dart head is disposed on the first dart rod, and the tail wing connecting part is disposed on the second dart rod.

A threaded groove is formed in the first dart rod, a threaded column is disposed on the second dart rod, and the threaded groove is matched with the threaded column.

A telescopic part is disposed on a rear portion of the dart rod, the tail wing connecting part is connected to the telescopic part, the outer diameter of the telescopic part is smaller than the inner diameter of the sleeve, and a rear end of the telescopic rod is inserted into the sleeve.

The elastic piece is a spring.

Compared with the prior art, the dart with a telescopic tail wing provided by the invention has the following advantages: the tail wing can rotate on the tail wing connecting part and can telescope, so that when the rear end of the tail wing suffers from a certain pressure or impact force, the limiting part in the sleeve compresses the elastic piece to enable the tail wing to move forwards without moving the dart rod; when the force applied to the rear end of the tail wing disappears, the tail wing returns to the original position under the effect of the elastic piece. In case of a collision, the tail wing can rotate to reduce the force, so that compared with the prior art, the tail wing is better in collision resistance, low in damage rate and long in service life. The dart is simple in structure, easy to assemble and low in production cost.

BRIEF DESCRIPTION OF THE DRAWINGS

To more clearly explain the technical solutions of the embodiments of the invention or the prior art, the drawings used for describing the embodiments of the invention or the prior art will be brief introduced below. Obviously, the drawings in the following description are merely for some embodiments of the invention, and those ordinarily skilled in the art can obtain other drawings according to the following ones with creative labor.

DETAILED DESCRIPTION OF THE INVENTION

Figure 1:
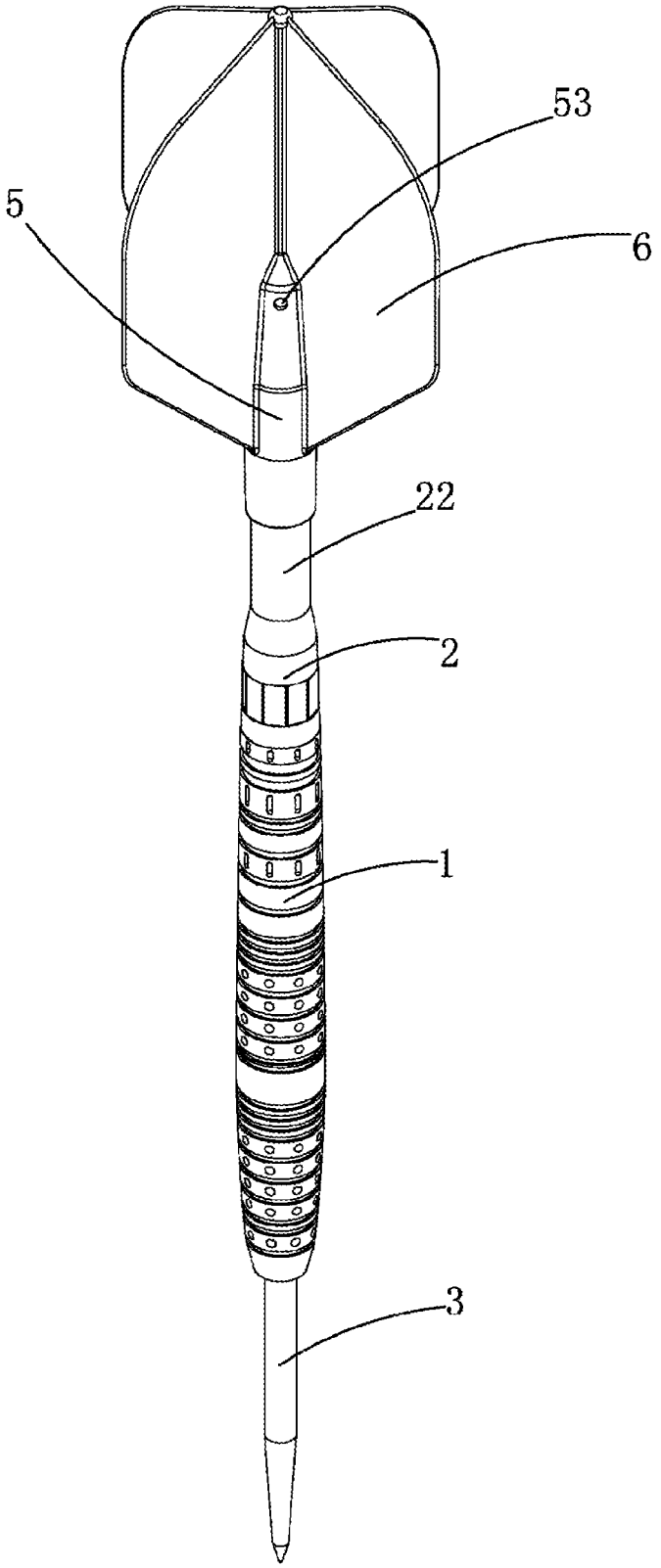
FIG. 1 is a structural view of the invention.

To clarify the purposes, technical solutions and advantages of the invention, the technical solutions of the invention will be expounded below. Clearly, the embodiments in the following description are merely illustrative ones, and are not all possible ones of the invention. All other embodiments obtained by those ordinarily skilled in the art on the basis of the following ones without creative labor should also fall within the protection scope of the invention.

Referring to FIG. 1 to FIG. 5, according to an embodiment of a dart with a telescopic tail wing provided by the invention, the dart comprises a dart rod, a dart head 3 disposed at a front end of the dart rod, and a tail wing disposed at a rear end of the dart rod, wherein the tail wing is movably disposed on the dart rod, a tail wing connecting part 4 is disposed at the rear end of the dart rod, the tail wing comprises a sleeve 5 and multiple wing blades 6 disposed on the sleeve 5, a clamping part is disposed on the tail wing connecting part 4, a limiting part 51 is disposed in the sleeve 5, the tail wing connecting part 4 is inserted into the sleeve 5, the clamping part stretches from one side to the other side of the limiting part 51 and is matched with the limiting part 51, and an elastic piece 7 is disposed around the tail wing connecting part 4 and is located between the limiting part 51 and the dart rod. The elastic piece 7 is located on one side of the limiting part 51, and the clamping part is located on the other side of the limiting part 51. The tail wing of the invention can rotate on the tail wing connecting part 4 and can telescope, so that when the rear end of the tail wing suffers from a certain pressure or impact force, the limiting part 51 in the sleeve 5 compresses the elastic piece 7 to enable the tail wing to move forwards without moving the dart rod; when the force applied to the rear end of the tail wing disappears, the tail wing returns to the original position under the effect of the elastic piece 7. In case of a collision, the tail wing can rotate to reduce the force, so that compared with the prior art, the tail wing is better in collision resistance, low in damage rate and long in service life. The dart is simple in structure, easy to assemble and low in production cost.

Figure 2:
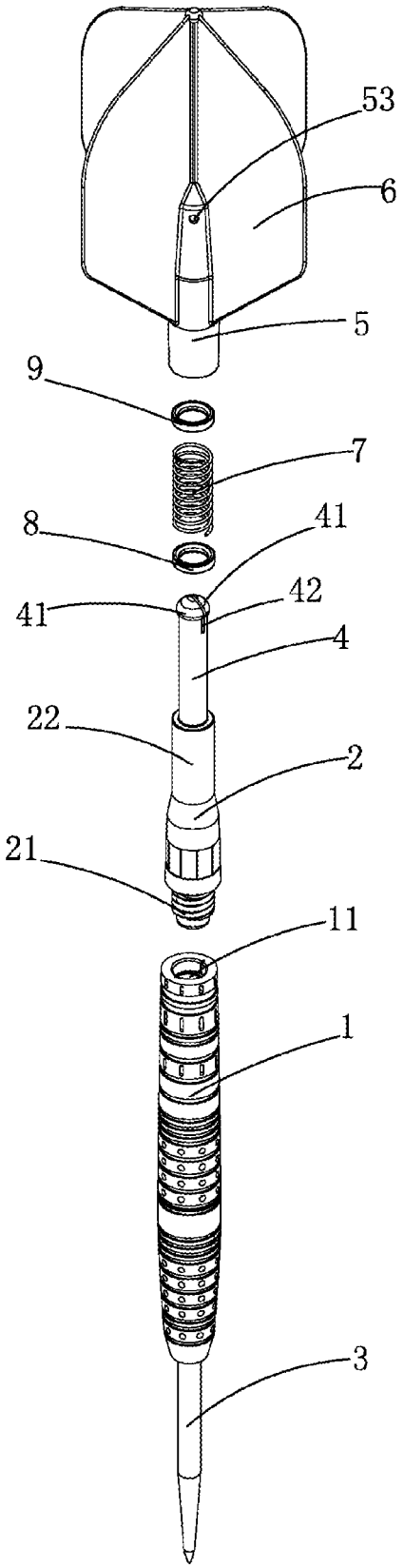
FIG. 2 is an exploded view of the invention.
Figure 3:
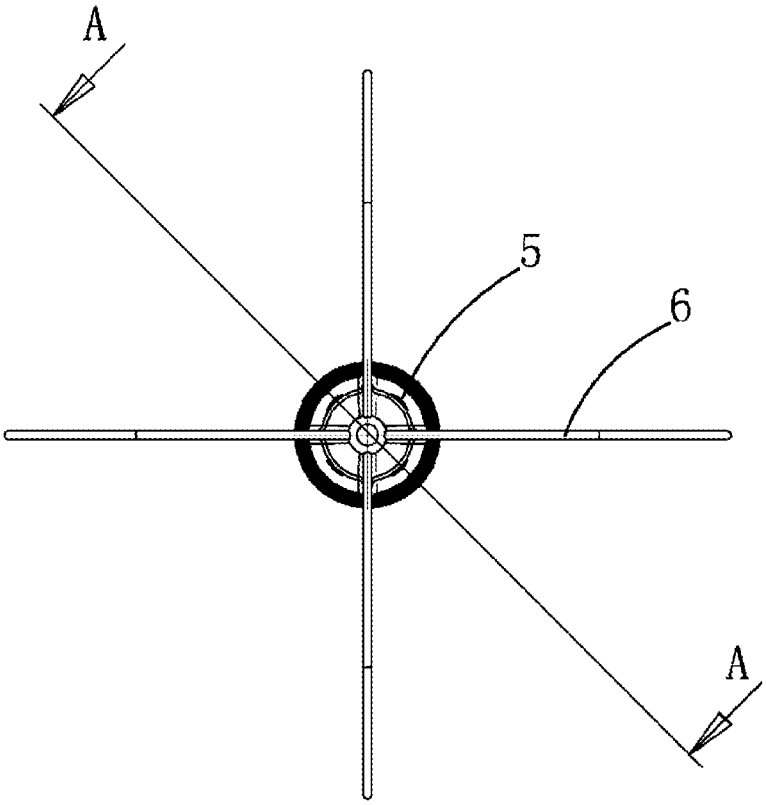
FIG. 3 is a top view of the invention.
Figure 5:
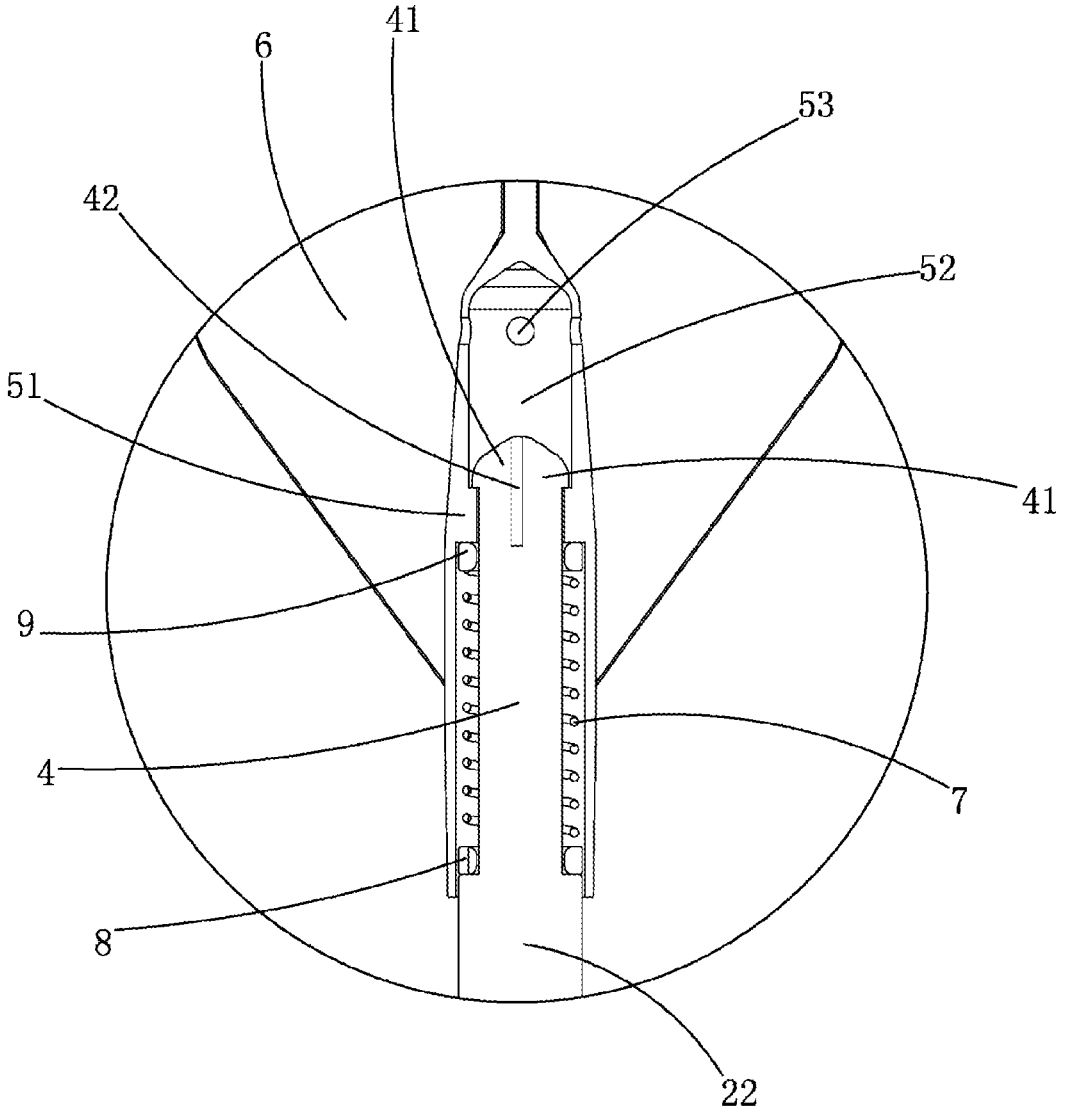
FIG. 5 is an enlarged view of part B in FIG. 4.

Referring to FIG. 2 and FIG. 5, according to this embodiment of the invention, a telescoping cavity 52 is formed between the bottom of the sleeve 5 and the limiting part 51, and the clamping part is located in the telescoping cavity 52. The ratio of the depth of the telescoping cavity 52 to the height of the clamping part is 10:1-2:1, and is preferably 2.5:1 in this embodiment. The clamping part is limited in the telescoping cavity 52 through the limiting part 51, so that when the tail wing telescopes, the clamping part telescopes in the telescoping cavity 52. A telescopic part 22 is disposed on a rear portion of the dart rod, the tail wing connecting part 4 is connected to the telescopic part 22, the outer diameter of the telescopic part 22 is smaller than the inner diameter of the sleeve 5, and a rear end of the telescopic part 22 is inserted into the sleeve 5. The telescoping amplitude of the tail wing depends on the depth of the telescoping cavity 52 and the height of the clamping part, the telescoping cavity 52 and the clamping part not only ensure that the telescoping amplitude of the tail wing can effectively buffer most impact force, but also ensure the stability of the tail wing in the flying process of the dart, so that the tail wing is prevented from shaking, and the shooting accuracy of the dart is guaranteed.

Referring to FIG. 1, FIG. 2 and FIG. 5, according to this embodiment of the invention, an air hole 53 is formed in a side wall of the telescoping cavity 52. The air hole 53 can rapidly balance the air pressure in the telescoping cavity 52 and the air pressure in the outside to reduce the resistance from the air pressure when the tail wing telescopes, so that the telescoping flexibility of the tail wing is improved, and damage to the tail wing is reduced.

Referring to FIG. 2 and FIG. 5, according to this embodiment of the invention, a first gasket 8 and a second gasket 9 are also disposed around the tail wing connecting part 4 and are located at two ends of the elastic piece 7, respectively. The first gasket 8 is located between the elastic piece 7 and the dart rod, and the second gasket 9 is located between the elastic piece 7 and the limiting part 51. The first gasket 8 and the second gasket 9 can prevent the two ends of the elastic piece 7 from being stuck in the dart rod and the limiting part 51 and particularly can guarantee the flexibility between the sleeve 5 and the tail wing connecting part 4 when the elastic piece 7 is a spring. Moreover, the first gasket 8 and the second gasket 9 have a support function and can reduce the clearance between the sleeve 5 and the tail wing connecting part 4, so that the stability of the tail wing in the flying process of the dart is guaranteed.

Referring to FIG. 5, according to this embodiment of the invention, the limiting part 51 is an annular protrusion circumferentially disposed on an inner wall of the sleeve 5. The annular protrusion and the sleeve 5 are formed integrally, so that the limiting part 51 is simple in structure and high in reliability.

Referring to FIG. 2 and FIG. 5, according to this embodiment of the invention, a front end of the tail wing connecting part 4 is connected to the dart rod, and the clamping part is disposed at a rear end of the tail wing connecting part 4. By disposing the clamping part at the rear end of the tail wing connecting part 4, the telescoping amplitude of the tail wing can be increased. The clamping part comprises at least two elastic clamping blocks 41 which are disposed at the rear end of the tail wing connecting part 4, and a gap 42 is formed between every two adjacent elastic clamping blocks 41. Two elastic clamping blocks 41 are adopted preferably in this embodiment. When the clamping part penetrates through the limiting part 51, the clamping part will be squeezed after entering the limiting part 51 because the outer diameter of the clamping part is greater than the inner diameter of the limiting part 51, the elastic clamping blocks 41 draw close to each other, and the gaps between the elastic clamping blocks 41 are compressed. After the clamping part penetrates through the limiting part 51, the elastic clamping blocks 41 stretch, and the clamping part returns to normal and is matched with the limiting part 51 to be limited. The clamping part is simple in structure, easy to machine and low in production cost, can be reliably matched with the limiting part 51, and can improve the assembly efficiency of the tail wing connecting part 4 and the sleeve 5.

Figure 4:
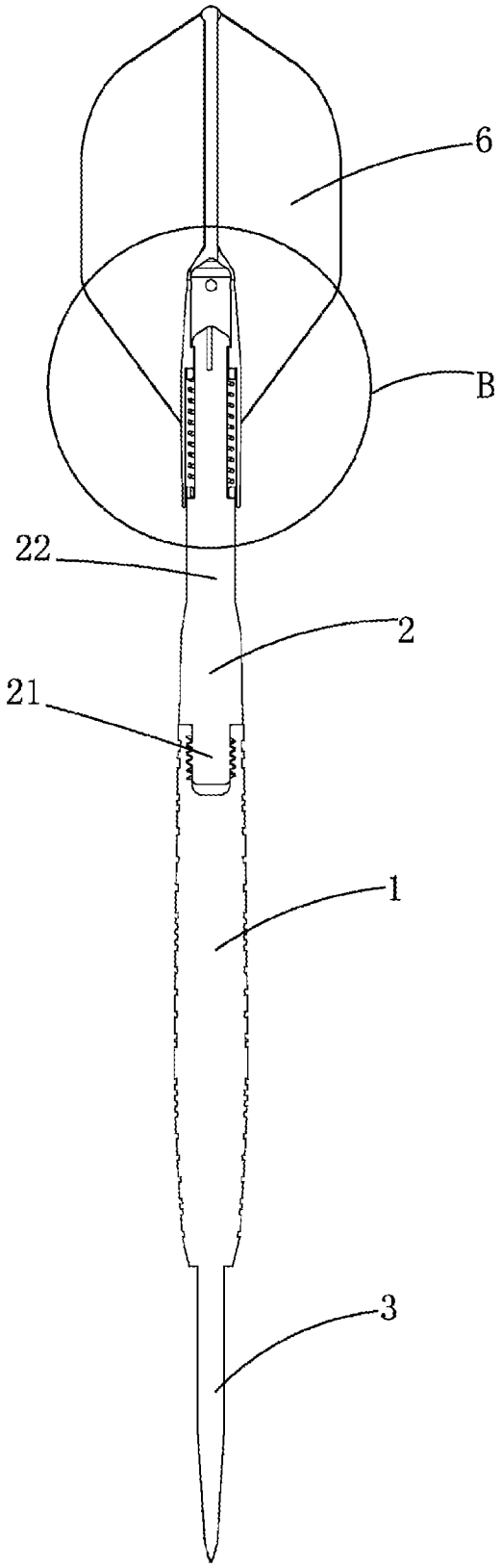
FIG. 4 is a sectional view along A-A in FIG. 3.

Referring to FIG. 1, FIG. 2 and FIG. 4, according to this embodiment of the invention, the dart rod comprises a first dart rod 1 and a second dart rod 2 which are detachably assembled, the dart head 3 is disposed on the first dart rod 1, and the tail wing connecting part 4 is disposed on the second dart rod 2. The tail wing connecting part 4 and the second dart rod 2 are formed integrally, and the dart rod of this structure facilitates the assembly of the tail wing. In specific implementation, the first dart rod 1 may be made of metal and the second dart rod 2 may be made of plastic to ensure that the center of gravity of the dart is near the front. The dart is a consumable, and when the first dart rod 1 or the second dart rod 2 is damaged, only one needs to be changed, so that the product cost of the dart is reduced. A threaded groove 11 is formed in the first dart rod 1, a threaded column 21 is disposed on the second dart rod 2, and the threaded groove 11 is matched with the threaded column 21. The first dart rod 1 and the second dart rod 2 are connected in a threaded manner, thus being easy to assemble and high in connecting strength.

Referring to FIG. 2 and FIG. 5, according to this embodiment of the invention, the elastic piece 7 is a spring. The spring used as the elastic piece 7 is simple in structure, convenient to assemble, good in fatigue resistance and low in production cost.

The aforesaid description is merely used for explaining specific implementations of the invention, and is not intended to limit the protection scope of the invention. All variations or substitutions easily obtained by any skilled in the art within the technical scope of the invention should fall within the protection scope of the invention. Therefore, the protection scope of the invention should be subject to the protection scope of the claims.

What is claimed is:

1. A dart with a telescopic tail wing, comprising a dart rod, a dart head disposed at a front end of the dart rod, and a tail wing disposed at a rear end of the dart rod, wherein the tail wing is movably disposed on the dart rod, a tail wing connecting part is disposed at the rear end of the dart rod and comprises a sleeve and multiple wing blades disposed on the sleeve, a clamping part is disposed on the tail wing connecting part, a limiting part is disposed in the sleeve, the tail wing connecting part is inserted into the sleeve, the clamping part stretches from one side to another side of the limiting part and is matched with the limiting part, and an elastic piece is disposed around the tail wing connecting part and is located between the limiting part and the dart rod; a telescoping cavity is formed between a bottom of the sleeve and the limiting part, and the clamping part is located in the telescoping cavity; the ratio of a depth of the telescoping cavity to a height of the clamping part, is 10:1-2:1, and the limiting part is an annular protrusion circumferentially disposed on an inner wall of the sleeve; a front end of the tail wing connecting part is connected to the dart rod, and the clamping part is disposed at a rear end of the tail wing connecting part; and the clamping part comprises at least two elastic clamping blocks disposed at the rear end of the tail wing connecting part, and a gap is formed between every two adjacent said elastic clamping blocks.

2. The dart with a telescopic tail wing according to claim 1, wherein an air hole is formed in a side wall of the telescoping cavity.

3. The dart with a telescopic tail wing according to claim 1, wherein a first gasket and a second gasket are also disposed around the tail wing connecting part and are located at two ends of the elastic piece, respectively.

4. The dart with a telescopic tail wing according to claim 1, wherein the dart rod comprises a first dart rod and a second dart rod which are detachably assembled, the dart head is disposed on the first dart rod, and the tail wing connecting part is disposed on the second dart rod.

5. The dart with a telescopic tail wing according to claim 1, wherein a telescopic part is disposed on a rear portion of the dart rod, the tail wing connecting part is connected to the telescopic part, an outer diameter of the telescopic part is smaller than an inner diameter of the sleeve, and a rear end of the telescopic part is inserted into the sleeve.

6. The dart with a telescopic tail wing according to claim 1, wherein the elastic part is a spring.

* * * * *